United States Patent [19]

Berger et al.

[11] Patent Number: 4,887,399

[45] Date of Patent: Dec. 19, 1989

[54] SOUNDPROOF ROOF CURB

[76] Inventors: Richard C. Berger, Off Split Rock Rd., Syosset, N.Y. 11791; Paul L. Berger, 28 Moss La., Jericho, N.Y. 11753

[21] Appl. No.: 682,683

[22] Filed: Dec. 17, 1984

[51] Int. Cl.[4] ..... E04B 7/18

[52] U.S. Cl. ..... 52/27; 248/678

[58] Field of Search ..... 52/27, 167; 248/237, 248/676, 678

[56] References Cited

U.S. PATENT DOCUMENTS

| | | | |
|---|---|---|---|
| 2,687,270 | 8/1954 | Robinson | 248/678 |
| 3,090,586 | 5/1963 | Schwegler et al. | 248/678 |
| 3,878,655 | 4/1975 | Toth et al. | 52/27 |
| 4,174,482 | 11/1979 | Bollman | 248/678 |
| 4,413,450 | 11/1983 | Brower | 52/27 |
| 4,513,939 | 4/1985 | Berger et al. | 52/27 |

*Primary Examiner*—Michael Safavi

[57] ABSTRACT

The unavoidable "dead" space beneath a rooftop site installed air conditioner is soundproofed, as well as weatherproofed, by fiberglass boards wherein the sound passes through open wire mesh sides of the supporting curb of the air conditioner into absorbing contact with these boards, instead of reverberating off prior art solid metal walls which heretofore bounded this dead space.

1 Claim, 3 Drawing Sheets

SOUNDPROOF ROOF CURB

The present invention relates generally to a roof curb support for an air conditioner or the like, and more particularly to improvements embodied therein which render the curb practically soundproof, with no attendant disadvantages.

In known roof curbs, such as illustrated and described in U.S. Pat. No. 4,413,450, the area beneath the air conditioner supported thereon unavoidably creates a sound chamber in which the noise of the vibrating unit, as well as external noise, is magnified or intensified by reverberation thereof off the solid metal sides of the curb. This noise is distracting to those in work areas in the vicinity of the rooftop opening over which the air conditioner is installed, and, as a solution, requires the use of additional and costly soundproofing panels.

Broadly, it is an object of the present invention to provide, with minimum expense and modification of existing weatherproofing techniques applied to rooftop curbs, a roof curb that is soundproof as well as weatherproof. More particularly, it is an object to render soundproof-effective the fiberglass boards or panels which now provide the weatherproofing function for the roof curbs, thus making a significant double use of this rooftop installation component.

A soundproof roof curb for an air handling unit which demonstrates objects and advantages of the present invention is of the type operatively disposed above a roof opening, and typically has four sides which bound a sound chamber that is necessarily created between the roof opening and the air handling unit which is mounted on the curb support. The improvement to this curb support which renders it soundproof includes in each curb support side an opening of a substantial size which is in communication with the sound chamber. A wire mesh closure is then disposed externally in covering relation over each said opening, and board means having sound-absorbing and weatherproofing properties is supported externally on the wire mesh. As a result, any sound created in the sound chamber is subject to removal by absorption into the board means by the contact therewith through the openings in the wire mesh, whereas in the prior art this sound reverberated off solid walls and created a noise problem.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

Figure 1:
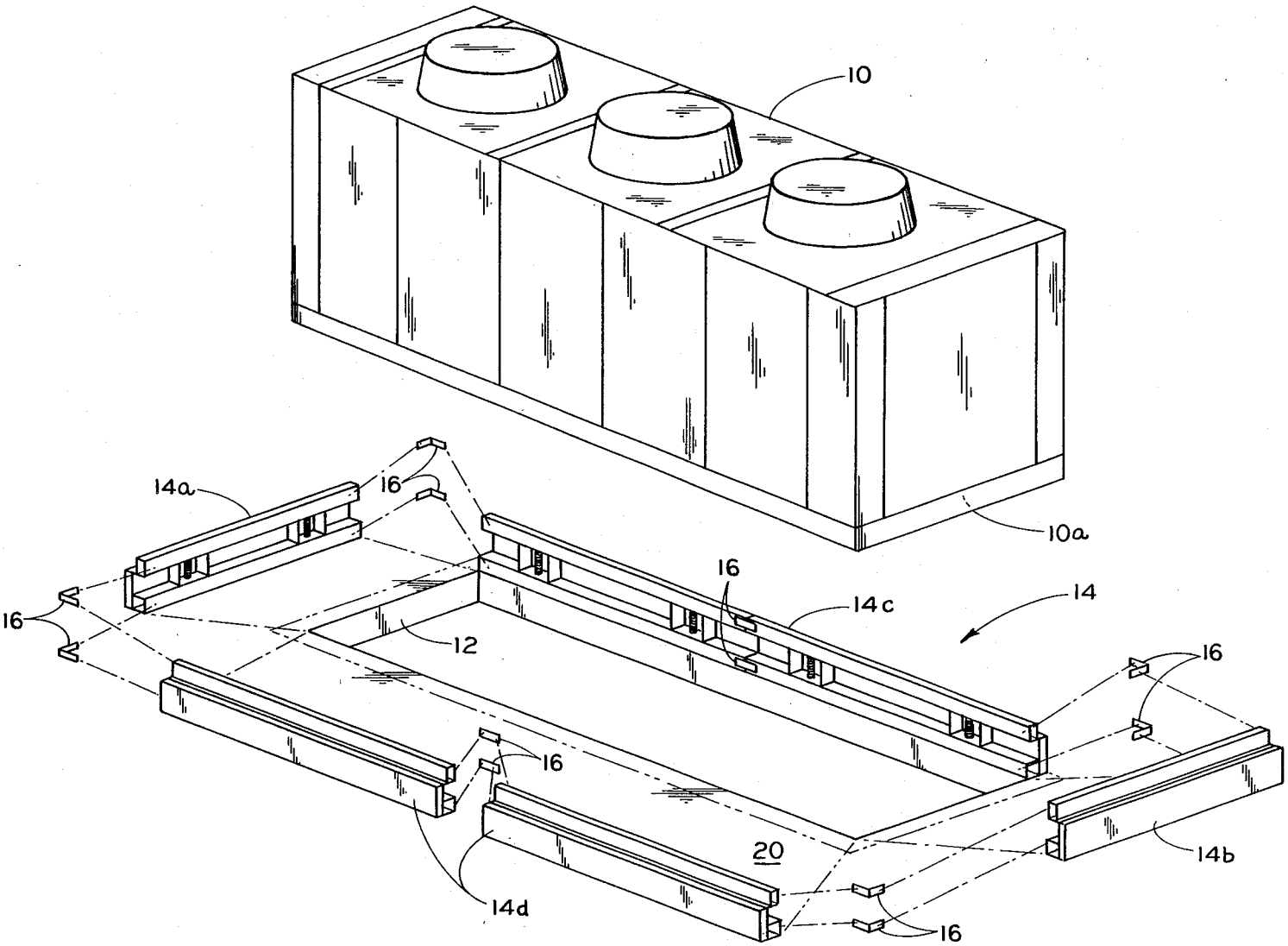
FIG. 1 is a perspective view of a typical air conditioning unit and the manner in which it is installed on a rooftop site using a supporting curb.

In our prior application entitled "An Improved Vibration Absorption Mounting for a Rooftop Air Handling Unit, or the Like", filed on June 4, 1984, and assigned Ser. No. 617,267, as well as in issued patents, such as U.S. Pat. No. 4,413,450, there are various structures illustrated and described that are known as curbs and are used to support air handling units, such as an air conditioner, at a rooftop installation. Thus, as shown in FIG. 1, an air conditioning unit 10 is required to be supported above a rooftop opening 12 through which conduits and other access or attachments are made to it as are required during the operation of the air handling unit. To support the air conditioning unit 10 it is the practice to use a so-called curb that is herein generally designated 14, which curb consists of four sides which are assembled in encircling relation about the opening 12. Thus, as shown in FIG. 1, the curb 14 is typically rectangularly shaped, just like the opening 12, and includes two short lengths **14*a* and 14*b* at its opposite ends and two long opposite sides 14*c* and 14*d* which in turn may also be formed by two shorter lengths approximately the size of the ends 14*a*, 14*b*. In assembling the components or lengths 14*a*–14*d*, use is made of connecting brackets, individually and collectively designated 16**, which connect the lengths at the corners and at other required locations.

Thus far what has been described is known prior art and has been set forth to illustrate that in a typical roof curb mounting for an air conditioning unit there is necessarily created a space, or what may be aptly characterized as a sound chamber 18 in the area or space between the bottom **10*a* of the air conditioning unit and the roof surface 20. The height of this sound chamber 18 is, of course, the height of the sides 14*a*–14*d* of the roof curb 14**.

Figure 2:
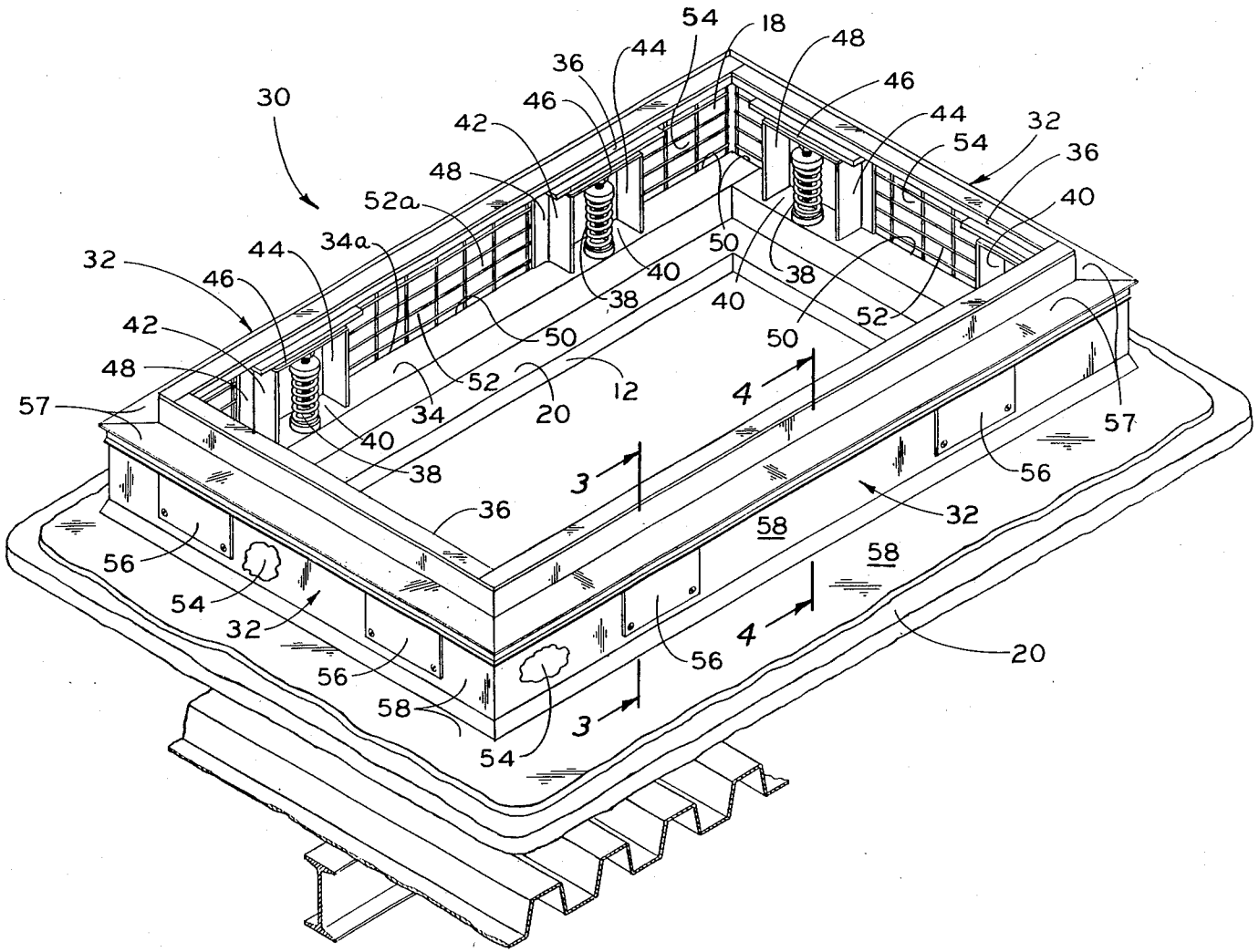
FIG. 2 is similarly a perspective view, but illustrating the structural features of the curb, and including specifically the features thereof which constitute the within invention; and FIGS. are each side elevational views, in section, respectively taken along lines 3—3 and 4–4 of FIG. 2, illustrating further structural details of the curb.

Reference should now be made to FIG. 2, which illustrates a roof curb, generally designated 30, which it will be understood is essentially of the same nature and character as curb 14 of FIG. 1. That is, roof curb 30, like previously described curb 14, has four sides, individually and collectively designated 32, which in practice support an air handling unit or air conditioner 10 and which, of necessity, therefore bounds a sound chamber 18 in the area beneath the air conditioner and above the roof surface 20. Also, as illustrated in FIG. 2, curb 30 is in encircling relation about the roof opening 12 through which access is made to the air conditioner being supported thereon. What distinguishes the roof curb 30 from the prior art and previously described curb 14, however, is that said roof curb 30 is rendered soundproof by the improvements which it embodies, despite the fact that there is vibration in the air conditioner being supported and there is a sound chamber 18 in which these vibrations would ordinarily reverberate and create audible sound and noise of a level that could be heard through the roof opening 12 and as such be distracting to workers in work areas beneath the rooftop-installed air conditioner. Only so much of the structural features of the roof curb 30 that contributes to the soundproofing aspect thereof need be understood, and therefore only these structural features will be described.

Figure 4:
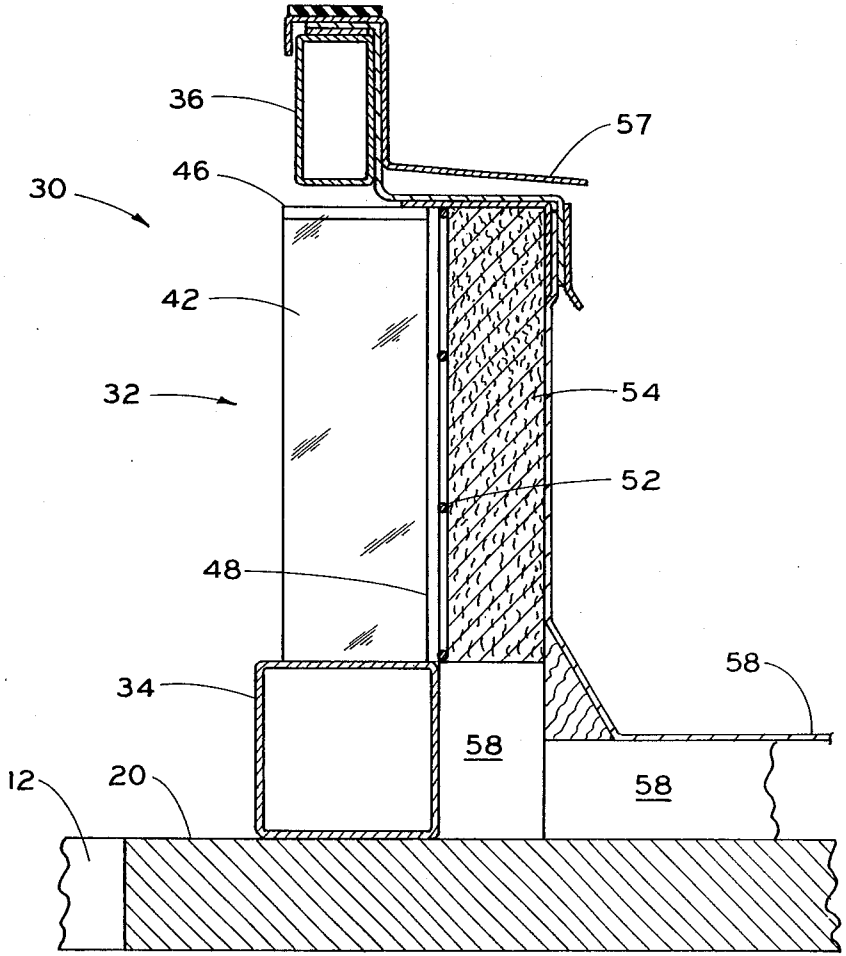
Figure 3:
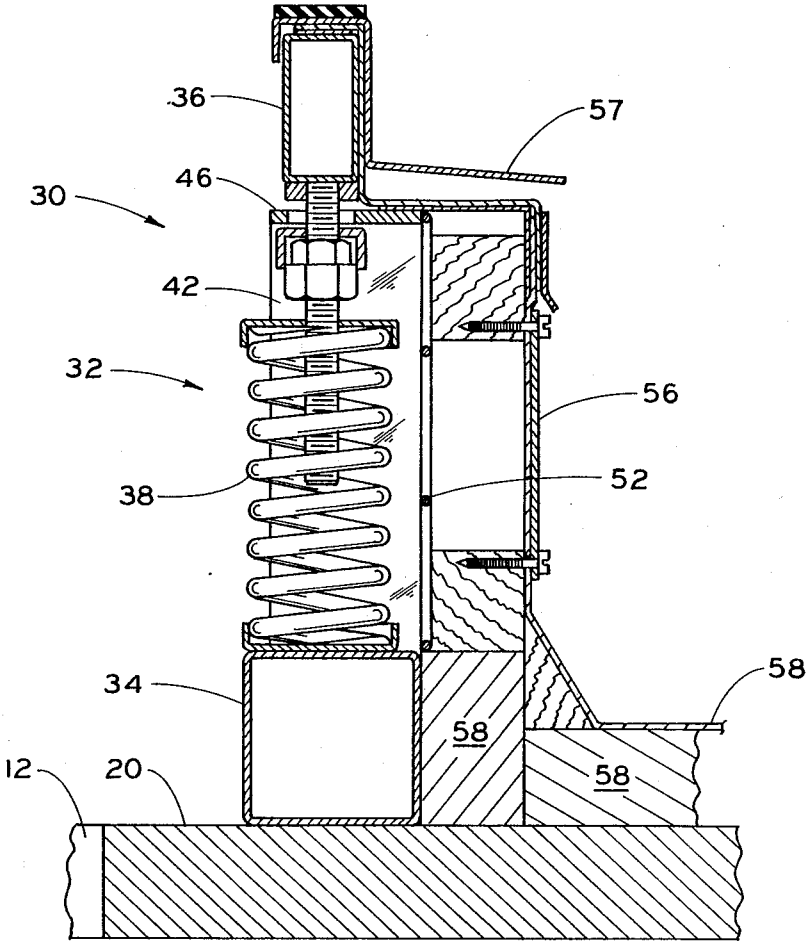

As generally understood, and as is illustrated in FIG. 2 and in the cross section views of FIGS. 3 and 4, each length section 32 of the curb 30 consists of a lower rail or extrusion 34 and an upper rail or extrusion 36. These rails are not physically attached to each other, since the upper rail 36 which is physically attached to the air conditioning unit 10 must be free to vibrate relative to the lower rail 34. To this end, the upper rail 36 is placed in superposed relation above the lower rail 34 and a number of individual helical springs 38 are operatively appropriately arranged to absorb the vibration of the upper rail 36 and thus to allow the vibratory degree of movement referred to. As is perhaps best shown in FIG. 2, each spring 38 is mounted in a spring compartment 40, which compartment 40 is formed by two vertically oriented sides 42 and 44 which are welded or otherwise permanently attached to the lower rail 34, and such compartment 40 is completed by a cross member 46. Thus, the sides 42 and 44 of each spring compartment 40 are vertically oriented structural features which are permanently affixed to the lower rial 34. Still referring to FIG. 2, it will be noted that there is a laterally extending leg to each of the sides 42 and 44 thus giving the two said members 42 and 44 an L-shape in cross section.

Still referring to FIG. 2, it will be understood that in the construction of the lower rail 34 that, except for the laterally extending legs 48 towards each other, the lower curb 34 has an opening or no wall structure in the length portion between the legs 48. Thus, the area along the lower curb 34 between the legs 48 which extend towards each other is an open area and defines a side opening 50 in each of the roof sides 32. As clearly illustrated in FIG. 2, the opening 50 exists in all of the length portions between the spring compartments 40 for the springs 38.

An essential part of the present invention is the provision of the openings 50 in the embodiment of the lower extrusion 34 of the curb sides 32. In the prior art, the lower extrusion was fabricated with a solid metal wall in each area that is now occupied by an opening 50. As a result, any noise created within the sound chamber 18 was reverberated by its contact with these prior art solid walls around the sound chamber 18 and, as a consequence, the reverberating noise reached a decibel level that was annoying and distracting to workers in the area.

Instead of being a solid wall, each opening 50 is, in accordance with the present invention, provided with a wire mesh 52 which is welded or otherwise attached in spanning relation between the legs 48 and along the external edge 34*a* of the extrusion 34. The function of the wire mesh 52 is to support fiberglass boards 54 which are mounted externally about the curb 30 and provide, in a well understood manner, a weatherproof barrier for the roof opening 12. In accordance with an essential aspect of the present invention, it is also recognized that the fiberglass material or construction of each board 54 not only has weatherproofing properties, but it also is effective in absorbing sound. Thus, the noise created within the sound chamber 18 is able to pass through the openings 52*a* of the wire mesh 52 and thus make contact with the internal surfaces of the fiberglass boards 54. This contact, of course, results in the sound being absorbed by the fiberglass material and thus in a significant diminishment in the decibel level thereof, thereby correspondingly greatly and significantly decreasing the possibility of any noise distractions to any workers in the area of the air conditioner.

Completing the construction of the improved soundproof roof curb 30 of the within invention are access openings to the springs 38 in order to permit the replacement of the springs. In FIG. 2, these access openings are shown temporarily covered over by closures 56. Also, proper weatherproofing of the roof curb 30 dictates the use of a metal strip 57 to provide a favorable gravity flow of rain, sleet, or the like, and a so-called cant strip and other weatherproofing materials, collectively designated 58, appropriately installed about the base of the curb 30.

From the foregoing, it should be readily appreciated that there has been described herein an improved soundproof roof curb in which double use has been made of the fiberglass boards to achieve not only a weatherproofing function, but also a sound-absorbing function. Fiberglass boards that have been found in practice to be effective for this double function are those sold as "fiberglass roof decking" by Owens Corning of Corning, N.Y., but of course the invention may be practiced using other appropriate materials. In this regard, a latitude of modification, change and substitution is intended in the foregoing disclosure and, in some instances, some features of the invention will be employed without a corresponding use of other features. Accordingly, it is appropriate that the appended claims be construed broadly and in a manner consistent with the spirit and scope of the invention herein.

What is claimed:

1. A soundproof roof curb of the type operatively disposed above a roof opening and having an air handling unit mounted thereon above said roof opening, said curb support comprising four sides bounding a sound chamber necessarily created between said roof opening and said air handling unit and in each curb support side there being an opening of a size that is substantially the entire size thereof in communication with said sound chamber, a closure disposed externally in covering relation over each said opening, and board means having sound-absorbing and weather-proofing properties supported externally on said closure, said closure being in the specific form of a wire mesh having openings throughout so that sound created in said sound chamber is subject to removal by absorption into said board means by the contact therewith through the openings in said wire mesh.

* * * * *